United States Patent [19]

Okada et al.

[11] 3,989,221

[45] Nov. 2, 1976

[54] FORM STRUCTURE FOR USE IN THE MAKING OF COLUMNAR OR THE LIKE CONCRETE PRODUCTS

[75] Inventors: Senri Okada, Tokyo; Mitsuo Ohoka, Ohtone; Shinzo Hasegawa, Yokohama, all of Japan

[73] Assignee: Nippon Concrete Kogyo Kabushiki Kaisha, Tokyo, Japan

[22] Filed: Dec. 9, 1974

[21] Appl. No.: 530,766

[52] U.S. Cl. ..... 249/173; 164/292; 425/435; 425/DIG. 5

[51] Int. Cl.[2] ..... B28B 21/82

[58] Field of Search ..... 249/137, 173; 425/425, 425/433, 435, 441, DIG. 5, DIG. 129; 164/292–293

[56] References Cited

UNITED STATES PATENTS

| | | | |
|---|---|---|---|
| 1,403,683 | 1/1922 | Gruenfeld, Jr. | 425/435 |
| 1,485,860 | 3/1924 | Ladd | 164/293 |
| 1,762,440 | 6/1930 | Howe | 249/173 |
| 1,785,586 | 12/1930 | Hume | 425/435 |
| 1,865,692 | 7/1932 | Hume | 425/435 |
| 2,189,071 | 2/1940 | Kopp | 249/137 |
| 3,098,764 | 7/1963 | Kao et al. | 425/435 |
| 3,110,074 | 11/1963 | Menzel et al. | 249/151 |
| 3,815,864 | 6/1974 | Loeber | 249/179 |

*Primary Examiner*—Francis S. Husar
*Assistant Examiner*—John McQuade
*Attorney, Agent, or Firm*—Oldham & Oldham Co.

[57] ABSTRACT

Labor-consuming bolting operation as required with conventional forms of the gapped or split type has been ingeniously expelled by the provision of a form structure comprised essentially of a rigid tubular frame, a resilient gapped tubular casing arranged therein as a form in which concrete is to be placed, and camming means arranged on the inside of the rigid frame and on the outside of the resilient casing and cooperable to act upon the resilient tubular casing radially and circumferentially thereof with axial movement of such resilient casing relative to the rigid frame so as to close the gap in the resilient casing while holding the latter in coaxial relation to the rigid frame, any loss of moisture content of concrete during centrifugal forming operation can be effectively prevented by arranging an appropriate packing element on the resilient casing along the gap therein.

4 Claims, 10 Drawing Figures

FORM STRUCTURE FOR USE IN THE MAKING OF COLUMNAR OR THE LIKE CONCRETE PRODUCTS

BACKGROUND OF THE INVENTION

This invention relates to improvements in form structures for use in the making of columnar or the like concrete products and more particularly in those of the kind usable in centrifugal forming processes.

Previously known form structures of the kind described have generally comprised of a substantially cylindrical or frustoconical tubular form which has a single longitudinally extending gap formed in its wall with a pair of flanges formed along the opposite edges of such gap or alternatively is of the type axially split into two half secions with flanges formed along the oppsite longitudinal adges thereof. With such conventional forms, it has been common practice to clamp together the opposite flanges formed along the gap or split edges of the form by bolt means to hold the form in a closed cylindrical or frustoconical shape for placing concrete therein and, upon completion of the forming operation, to release the bolts in order to enable the form to be opened for removal of the formed product therefrom. Such bolting procedure required to assemble and disassemble the form, however, has been very difficult to automatize because of the wide variety in size and shape of forms used and actually been performed exclusively by manual labor, incurring inefficiency and high cost of production.

SUMMARY OF THE INVENTION

To overcome the previous difficulties described above, the present invention provides a novel form structure of the kind described which comprises a tubular frame adapted to be driven to rotate about its own axis, a resilient tubular casing having a longitudinally extending gap formed in its wall and having an outer diameter smaller than the inner diameter of said tubular frame so as to be arranged therein for axial movement relative thereto, and camming means associated with said tubular frame and casing so as to act upon said tubular casing circumferentially and radially thereof with axial movement of such tubular casing relative to said tubular frame to close said gap in said tubular casing while holding the latter in a position coaxial with said tubular frame.

The primary object of the invention is to eliminate the need for any clamping bolts such as required with conventional forms.

Another object of the invention is to enable the longitudinally extending gap in the wall of said tubular casing to be automatically closed as the casing is moved in an axial direction relative to said tubular frame while allowing the gap to open with axial movement of the casing in an opposite direction to facilitate separation and removal of a columnar concrete product formed therein.

A further object of the invention is to tightly seal the gap in the tubular casing as it is closed to prevent any loss of moisture contained in the concrete placed in the casing. To attain this object, a pair of radially outwardly extending ribs or flanges are formed on the tubular casing along the opposite edges of the gap in the wall thereof and a packing element is arranged between such flanges so as to be compressed with the aid of ridge formation on the inner wall surface of the tubular frame as the tubular casing is moved in an axial direction to close the gap in the wall thereof.

These and other objects, features and advantages of the present invention will become apparent from the following description when taken in conjunction with the accompanying drawings.

DESCRIPTION OF THE PREFERRED EMBODIMENTS

Figure 1:
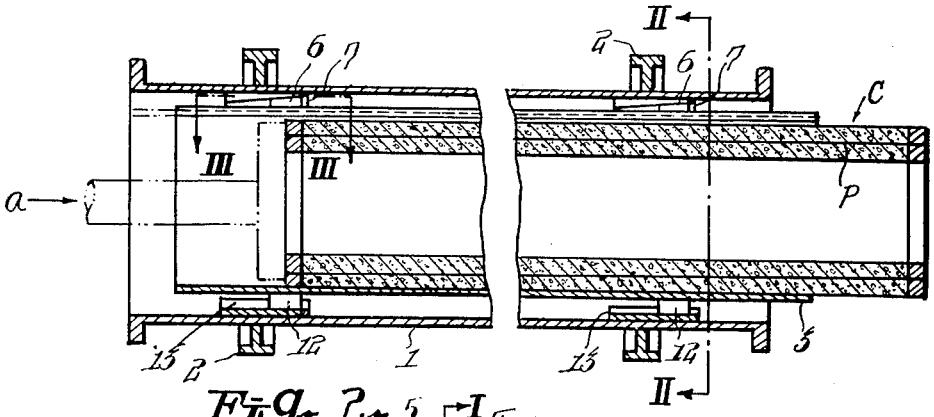
FIG. 1 is an axial cross-sectional side view of one preferred embodiment of the invention, taken along the line I—I in FIG. 2 and showing the embodiment with a concrete pipe already formed therein and now being pushed out.

One preferred embodiment of the invention will now be described with reference to FIGS. 1 to 4, in which reference numeral 1 indicates an outer tubular casing or frame of the form structure illustrated; and 3, an inner tubular casing thereof.

The tubular frame 1 is formed of steel pipe with a plurality of steel rings or tires 2 integrally secured to the outer periphery thereof at axially spaced intervals in coaxial relation therewith and, as will readily be understood, is mounted on support rolls of an appropriate form rotating machine, not shown, through the intermediary of steel tires 2 to be driven to rotate about its own axis together with the inner, tubular casing 3 for centrifugal forming of columnar concrete products.

The tubular casing 3, serving as a form proper in which concrete is actually placed, is resilient in nature, being formed of steel plate, and has an inner peripheral wall surface substantially conforming to the profile of columnar concrete products to be formed therein. The casing 3 also has a gap 4 formed in the wall thereof which extends longitudinally over the whole length of the casing in parallel with the axis thereof. It is to be understood that the gap 4 remains open in the free state of the resilient tubular casing 3. Also, a pair of radially outwardly extending ribs or flanges 5 are formed on the tubular casing 3 along the opposite edges of the gap 4 to extend longitudinally of the casing over the whole length thereof. Further, a plurality of guide projections 6 are formed on the outside of each of ribs 5 on the tubular casing 3 at axially spaced intervals, each extending only a limited distance longitudinally of the casing 3. All of such guide projections 6 are arranged in paired cooperating relationship, each of such projections formed on one of the paired ribs being disposed circumferentially opposite to the corresponding one of guide projections 6 formed on the other rib 5.

Figure 3:
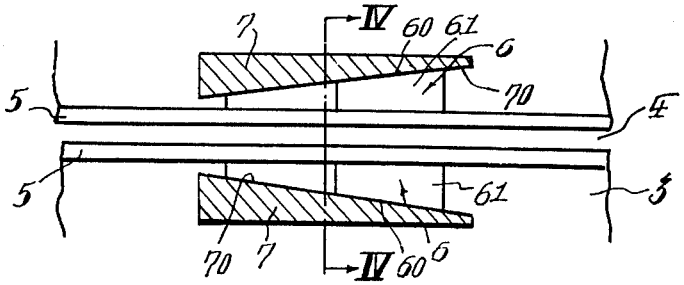
FIG. 3 is an enlarged fragmentary cross section taken along the line III—III in FIG. 1.
Figure 4:
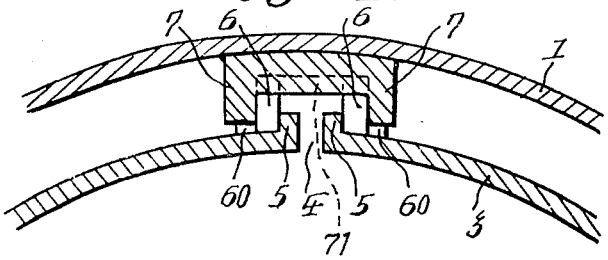
FIG. 4 is a fragmentary cross section taken along the line IV—IV in FIG. 3.

As shown in FIGS. 3 and 4, each of the guide projections 6 has an outside guide face 60 which is inclined in an axial direction of the tubular casing 3 to approach the inside surface of the guide projection which is parallel to the axis of the casing. Thus, the guide projections 6 in each pair have respective outside surfaces 60 so inclined as to define a distance therebetween which increases from one end to the other of the paired projections.

Provided on the outer tubular casing or frame 1 are a plurality of cam blocks which are fixed as by welding to the inner wall surface of the frame 1 at axially spaced intervals in axially aligned relation with each other and each include a pair of opposite camming projections 7 extended radially inwardly of the frame 1 for cooperation with the corresponding one of the pairs of guide projections 6 formed on the inner, tubular casing 3. As clearly seen in FIG. 3, each of the paired camming projections 7 has a greater axial length than the guide projections 6 and has an inside face 70 inclined in an axial direction to closely conform to the inclined outside face 60 of the adjacent one of guide projections 6.

It is to be observed that, with axial movement of the resilient tubular casing 3 relative to the tubular frame 1, the camming projections 7 in each pair act upon the corresponding pair of guide projections 6 through the interengagement of inclined side faces 60 and 70 of the respective projections 6 and 7 to force the ribs 5 formed on the tubular casing 3 circumferentially toward each other against the resiliency thereof until the ribs 5 are placed in abutting engagement with each other to close the gap 4 in the wall of the tubular casing 3. Obviously, the gap 4 closed in this manner will become open again under the resiliency of the casing 3 when the latter is moved axially in the opposite direction.

Incidentally, the other tubular casing or frame 1 should be designed with an internal diameter which affords a radial distance between the walls of inner and outer tubular casings 3 and 1 sufficient to ensure smooth interengagement and relative sliding movement between the paired guide and camming projections 6 and 7 respectively provided on the inner and outer casings 3 and 1. Though each pair of camming projections 7 has been shown and described above as integrally formed on a block welded to the tubular frame 1, such projections may alternatively be formed separate and individually secured directly to the inner wall surface of the frame 1 as by welding.

Referring again to FIGS. 1, 3 and 4, the guide projections 6 formed on the resilient tubular casing 3 also have each a top guide surface 61 which is inclined downwardly to the left as viewed in FIGS. 1 and 3, that is, in the direction in which the outside guide face 60 is inclined to approach the inside surface of the guide projection 6. On the other hand, the channel-like cam blocks secured to the inner wall surface of tubular frame 1 and each forming a pair of camming projections 7 have each a radially inwardly directed bottom camming surface 71 defined between the pair of camming projections 7 and inclined downwardly to the left as viewed in FIGS. 1 and 3 so as to closely conform to the inclined top guide surfaces of the adjacent pair of guide projections 6. As will readily be understood, when the resilient tubular casing 3 is axially moved relative to the tubular frame 1 to close the gap 4, the inclined bottom surfaces 71 of the cam blocks are brought into sliding face-to-face contact with the inclined top surfaces 61 of the respective pairs of guide projections 6 to force the ribs 5, formed along the opposite edges of gap 4 and adjacent inner casing edges, radially inwardly through the intermediary of guide projections 6. Accordingly, any eccentricity or radial deflection of the gapped region of resilient tubular casing 3 such as may otherwise take place under centrifugal force when the tubular casing 3 rotates together with the tubular frame 1 can be effectively prevented.

Figure 2:
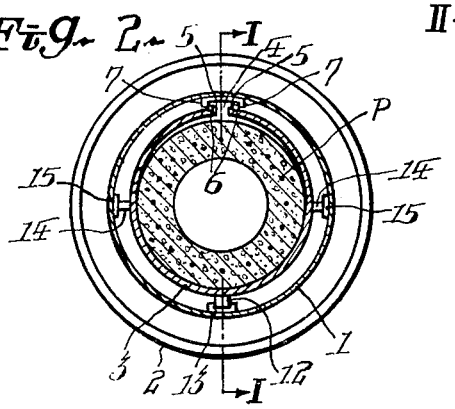
FIG. 2 is a transverse cross section of same taken along the line II—II in FIG. 1.

Further, as seen in FIGS. 1 and 2, a plurality of radial lugs 12 are fixed to the outer wall surface of the tubular casing 3 in an angular position 180° spaced apart from the gap 4 at axially spaced intervals and are fitted into respective channel pieces 13, which are secured to the inner wall surface of tubular frame 1, for axial sliding movement relative thereto.

With the arrangement described above, it will readily be appreciated that the resilient tubular casing 3 as placed in proper engagement with the tubular frame 1 can be supported coaxially therein simply by driving the tubular casing 3 in an axial direction until the gap 4 is completely closed.

Further, in cases where the resilient tubular casing 3 has a relatively large circumferential length and its wall regions 90° apart from the gap 4 may possibly be deflected or bulged radially outwardly under centrifugal force during forming operation, an appropriate restraining arrangement can readily be provided, for example, as illustrated in FIG. 2, in which reference numeral 14 indicates radial lugs secured as by welding to the outside of the tubular casing 3 at axially spaced intervals at respective locations 90° apart from the gap 4 and each having an end face inclined to the axis of the casing. Reference numeral 15 indicates bearing blocks secured as by welding to the inside wall surface of the tubular frame 1 in an arrangement similar to that of radial lugs 14 on resilient tubular casing 3 and each having a similarly inclined bearing surface. As will readily be noted, the inclined surfaces of radial lugs 14 and bearing blocks 15 are brought into sliding engagement with each other and cooperate to hold the tubular casing 3 in a circular cross-sectional shape throughout the forming operation.

In use of the form structure described above, first the tubular casing 3 is axially moved to a set position within the tubular frame 1 and in this way the longitudinally extending gap 4 in the wall of resilient tubular casing 3 is tightly closed. Then, a cage of reinforcing steel tendons for a concrete pipe or column to be formed is properly arranged in the resilient casing 3 and concrete is placed therein. Subsequently, the form structure is driven to rotate as a whole about its own axis in order to consolidate the concrete under centrifugal force, and the concrete formed in the tubular casing 3 is steam-cured until it solidifies to an appropriate hardness for its separation and removal from the tubular form or casing 3. After such curing, the tubular casing 3 is forced to move axially backward from its set position and thus allowed to expand under its own resiliency to open the gap 4. In this manner, most of the formed surface of the concrete column is separated from the adjacent inner peripheral surface of tubular casing 3 practically in an automatic fashion and the concrete product can now be readily removed out of the form structure just by pushing same axially out of the resilient tubular casing 3 by an appropriate thrust machine, as indicated in FIG. 1 by the arrow *a*.

Another preferred embodiment of the present invention is illustrated in FIGS. 5 to 8, in which the same references have been used as in FIGS. 1 to 4 for similar parts.

Figure 5:
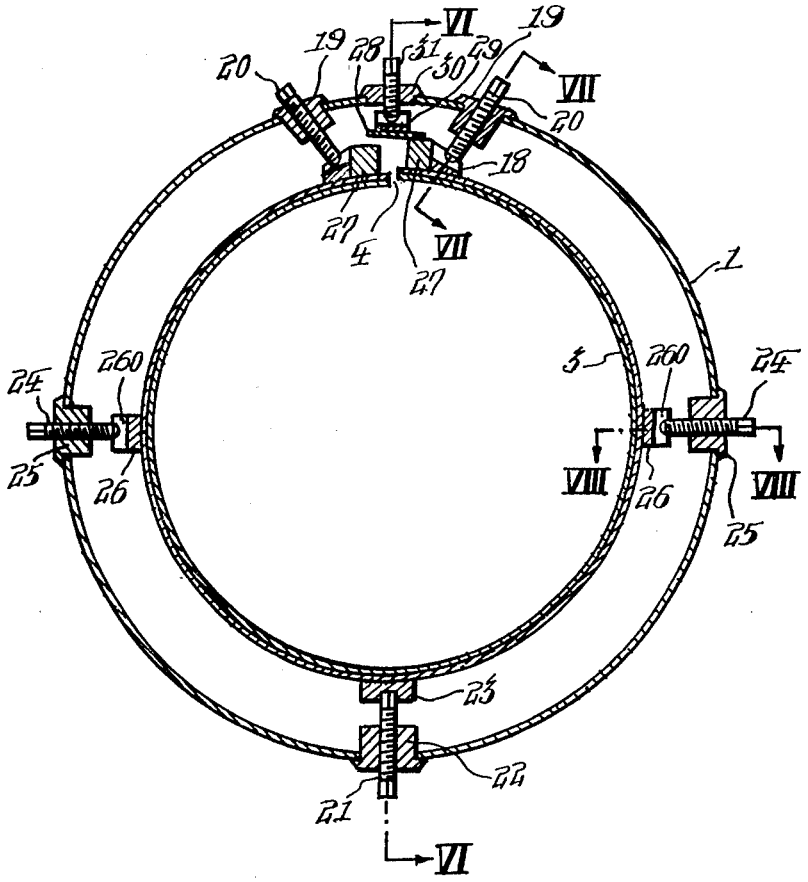
FIG. 5 is a transverse cross-sectional view of another embodiment of the present invention, taken along the line V—V in FIG. 6.
Figure 6:
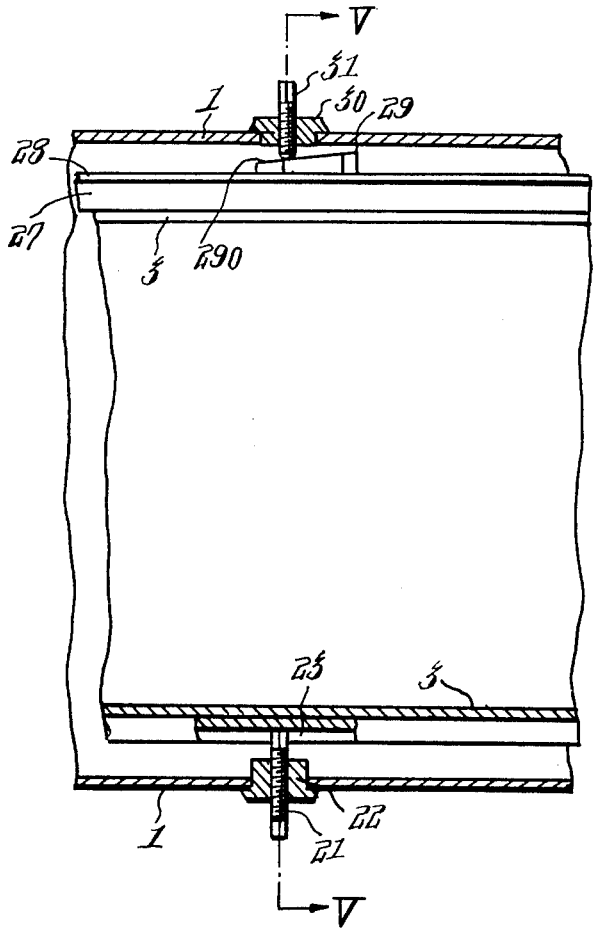
FIG. 6 is a fragmentary cross section taken along the line VI—VI in FIG. 5.
Figure 7:
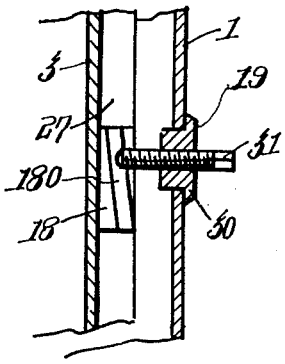
FIG. 7 is a fragmentary cross section taken along the line VII—VII in FIG. 5.

Referring first to FIGS. 5 and 6, the resilient tubular casing 3 in this embodiment includes a pair of axially extending radial ribs 27 secured by welding to the outer wall surface of the casing 3 along the opposite edges of the gap 4 formed in the casing wall and a plurality of pairs of opposite guide projections or camming projection 18 arranged on the outside of said respective radial ribs 27 at axially spaced intervals. Guide projections 18 have each a planar guide face 180 (FIG. 7) inclined at an angle of approximately 30° to the medial plane of the resilient casing 3 and also inclined slightly downward, or radially in an axial direction thereof.

As shown in FIG. 5, a pair of nut blocks 19 are fitted in the outer casing 1 for each of the pairs of guide projections 18 formed on the inner, resilient casing 3 and are secured in place by welding. A pair of bolts 20 are threaded through the respective nut blocks and oppositely inclined to the medial plane of inner casing 3 so as to be brought into abutting engagement with the inclined guide surfaces 180 of the respective paired guide projections 18. Fixed to one of axially extending radial ribs 27 formed on the inner, resilient casing 3 (the right-hand side rib in FIG. 5) is a support plate 28 which extends in parallel with the form axis and to which a plurality of guide projections 29 are fixed at axially spaced intervals. As seen in FIG. 6, each of guide projections 29 has a top guide surface 290 inclined downward in an axial direction of the casing 3. A plurality of nut blocks 30 are fitted in the outer tubular casing or frame 1 one for each of the guide projections 29 and a bolt 31 is threaded through each of nut blocks 30 for abutting engagement with the inclined top surface 290 of the respective guide projection 29.

Further, a plurality of ribs 23 are welded to the outside of resilient tubular casing 3 at an angular position 180° apart from the gap 4 and are each formed with a groove extending parallel to the axis of the casing 3. On the other hand, a plurality of nut blocks 22 are secured to the tubular frame 1 at axially spaced locations opposite to the respective grooved ribs 23 on the inner casing 3. A bolt 21 is threaded through each of the nut blocks 22 to slidably fit in the groove in the respective rib 23. This arrangement, allows the resilient tubular casing 3 to move axially relative to the tubular frame 1. As will readily be understood, the gap 4 in the wall of the tubular casing 3 can be effectively closed or opened with axial movement thereof relative to the frame 1 as long as the threaded bolts 20, arranged on the frame 1 opposite to the respective guide projections 18 on the tubular casing 3, are held extended inwardly beyond the inner wall surface of the frame 1 to an appropriate extent. On this occasion, the bottom wall region of resilient tubular casing 3, which is substantially 180° apart from the gap 4, is only translated in parallel to the adjacent wall of frame 1, but the opposite wall edge portions of resilient tubular casing 3 extending longitudinally along the gap 4 are not only displaced circumferentially toward or away from each other but also displaced radially of the tubular casing 3 to effectively close or open the gap 4 because of the presence of threaded bolts 20 on the frame 1. It is to be noted in this connection that the radial displacement of one of the radial ribs 27 arranged along the opposite edges of gap 4 is aided by the guide action of the inclined top surfaces of guide projections 29, which are arranged on the support plate 28 secured to the radial rib 27 so as to be engaged by the respective threaded bolts 31 secured to the frame 1, thus making sure that the circumferentially opposite wall edge portions of tubular casing 3 are joined together accurately to complete a geometric circle.

Figure 8:
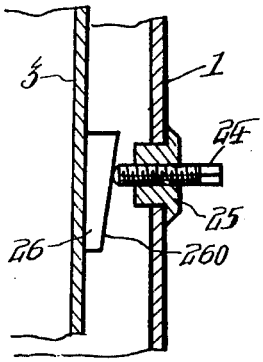
FIG. 8 is a fragmentary cross section taken along the line VIII—VIII in FIG. 5.

Further, as shown in FIGS. 5 and 8, a plurality of radial projections 26 are arranged on the outer wall surface of tubular casing 3 intermediate the gap 4 and grooved ribs 23, for example, at locations 90° apart therefrom, and at appropriate axially spaced intervals. These projections 26 are each shaped in substantially the same manner as guide projections 29 and have each a guide face 260 inclined in an axial direction of the casing 3. On the other hand, nut blocks 25 are secured to the tubular frame 1 at respective locations opposite to the guide projections 26 on tubular casing 3 with bolts 24 threadably fitted through the respective blocks 25 for abutting engagement with the respective guide projections 26. This arrangement serves the purpose of imparting to the opposite 90° regions of the wall of resilient casing 3 a radial displacement proportional to the gap opening or closing movement of the opposite wall edge portions of casing 3 during axial movement thereof relative to tubular frame 1 thereby to maintain the inner, tubular casing 3 at all times in a circular cross-sectional shape with no distortion. Such arrangement also serves the purpose of preventing any radially outward deflection or bulging of the intermediate wall regions of tubular casing 3 which may otherwise take place under centrifugal force when the form structure is driven to rotate with concrete placed in the tubular casing 3 for centrifugal forming. Though, in FIG. 5, the guide projections 26 and abutting bolts 24 are shown provided in two sets on the opposite sides of the form structure at locations 90° apart from gap 4, it is to be understood that they may be provided in any larger number of sets depending upon the diametral size of the form structure.

Figure 9:
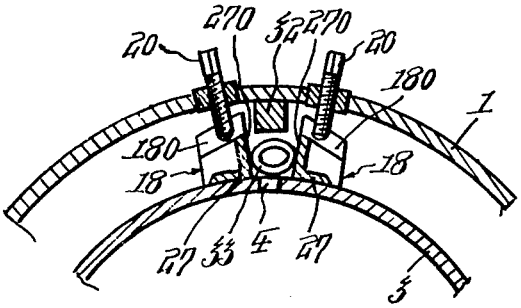
FIG. 9 is a fragmentary transverse cross-sectional view of a further embodiment of the invention, showing the tubular casing in open position.
Figure 10:
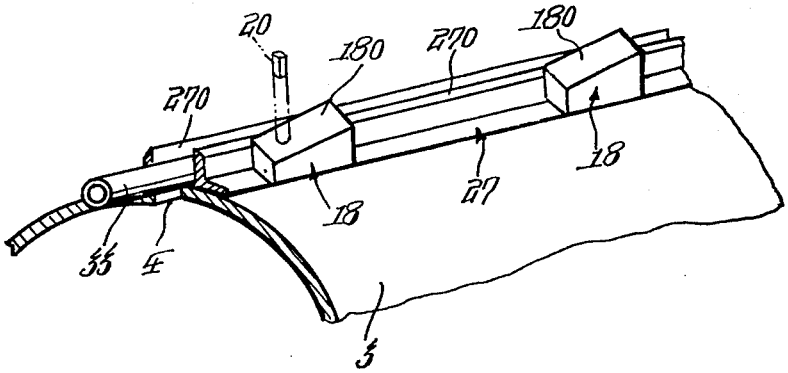
FIG. 10 is a fragmentary perspective view of same, showing the relationship between the ribs and guide projections formed on the tubular casing along the opposite edges of the gap therein.

FIGS. 9 and 10 illustrate a further embodiment of the invention which is basically the same in structure and function as the embodiment shown in FIGS. 5 to 8 except that it includes packing or seal means provided to prevent any moisture content of concrete placed therein from leaking out through the gap 4 in tubular casing 3 during centrifugal forming operation, in place of the arrangement including guide projections 29 and abutting bolts 31 in the embodiment of FIG. 5.

In FIGS. 9 and 10, in which the same references have been used as in FIGS. 5 to 8 for similar parts, reference numeral 270 indicates a pair of radial flanges secured to the outside of resilient tubular casing 3 along the opposite edges of the gap 4 formed therein and each taking the form of one of the legs of an angle bar 27, and 32 indicates a ridge secured to the inside of the outer casing or frame 1 and projecting radially inwardly therefrom into the space between the pair of radial flanges 270. Reference numeral 33 indicates a tubular packing element of rubber or the like elastic material arranged between the opposite radial flanges 270 and under the ridge 32 and extending longitudinally of the form structure over the entire length thereof. It is to be understood that the packing element 33 has such an outer diameter as to be sufficiently compressed around the periphery thereof. In other words, as the inner casing 3, initially assuming the state shown in FIG. 9 with its gap 4 kept open, in axially moved relative to tubular frame 1 to close the gap 4, the rubber packing 33 is radially compressed to extend wider under the combined action of the ridge 32 and flanges 270 against the adjacent wall edged portions of resilient tubular casing 3 to tightly seal the gap 4. Owing to this, any leakage through the closed gap of the moisture content of concrete subsequently placed in the resilient tubular casing 3 is effectively prevented during rotation of the form structure, enabling centrifugal forming operation with no danger of dehydration involved.

It will be apparent that, also with this embodiment, the gap 4 formed in the wall of resilient tubular casing 3 is effectively closed or opened with axial movement thereof relative to the tubular frame 1 under the control of paired guide projections 18 arranged on the pair of axially extending ribs 27, welded to the opposite side edges of gap 4, at appropriate axially spaced intervals and cooperating paired camming bolts 20 threadably fitted to the tubular frame 1.

While a few preferred embodiments of the invention have been shown and described, it will be apparent to close skilled in the art that various changes and modifications may be made therein without departing from the spirit of the invention or from the scope of the appended claims.

What is claimed is:

1. A form structure for use in the making of columnar or the like concrete products, comprising: a tubular frame (1) adapted to be driven to rotate about its own axis, a plurality of pairs of opposed camming projections (7) having both radially and axially inclined flat surfaces operatively secured to the wall surface of said tubular frame and projecting inwardly therefrom at axially spaced intervals in axially aligned relation to each other, and a resilient unitary tubular casing (3) having a gap (4) in its wall extending longitudinally the length thereof, fixedly carried by said tubular frame, and being axially inserted in said tubular frame substantially coaxially therewith, radially extending support means (21, 24) on said frame at side and bottom portions thereof operatively engaging said tubular casing; a plurality of pairs of guide camming projections (6) having both radially and axially inclined flat surfaces, secured to the outer wall surface of said resilient tubular casing along the opposite edges of said gap in such an arrangement that, when said resilient unitary tubular casing is inserted in said tubular frame to a predetermined axial position therein, said inclined surfaces of said pairs of guide camming projections will interengage with said inclined surfaces of said respective pairs of camming projections on said tubular frame so as to force said resilient tubular casing radially inwardly and force portions of said resilient tubular casing circumferentially toward each other to close said gap and, when said resilient tubular casing is moved back from said predetermined axial position in said tubular frame, said resilient tubular casing will expand under its own resiliency to open said gap.

2. A form structure for use in the making of columnar or the like concrete products, comprising: a tubular frame (1) adapted to be driven to rotate about its own axis, guide means including a plurality of pairs of opposed camming projections (7) having both radially and axially inclined surfaces operatively secured to the wall surface of said tubular frame and projecting inwardly therefrom at axially spaced intervals in axially aligned relation to each other, and a resilient unitary tubular casing (3) having a gap (4) in its wall extending longitudinally the length thereof, fixedly carried by said tubular frame and being axially inserted in said tubular frame substantially coaxially therewith, radially extending a support means on said frame at side and bottom portions thereof operatively engaging said tubular casing; guide members including a plurality of pairs of guide camming projections (6) having both radially and axially inclined surfaces secured to the outer wall surface of said rsilient tubular casing along the opposite edges of said gap in such an arrangement that, when said resilient unitary tubular casing is inserted in said tubular frame to a predetermined axial position therein, said inclined surfaces of said guide members are brought into sliding engagement with said inclined surfaces of said guide means on said tubular frame so as to force said resilient tubular casing radially inwardly to close said gap and, when said resilient tubular casing is moved back from said predetermined axial position in said tubular frame, said resilient tubular casing will expand under its own resiliency to open said gap, and said guide camming projection inclined surfaces comprise a laterally outer guide face (60) and a radially outer guide face (61), both inclined in a generally axial direction of said tubular casing and which slidably engage opposed inside wall faces (70) and a bottom wall face (71) and which comprise the inclined surfaces of the camming projections thereon.

3. A form structure for use in the making of columnar or the like concrete products, comprising: a tubular frame (1) adapted to be driven to rotate about its own axis, a plurality of pairs of opposite camming projections (20) operatively secured to the wall surface of said tubular frame and projecting inwardly therefrom at axially spaced intervals in axially aligned relation to each other, a resilient tubular casing (3) having a gap (4) in its wall extending longitudinally the length thereof and axially inserted in said tubular frame substantially coaxially therewith, radially extending support means on said frame at side and bottom portions thereof operatively engaging said tubular casing, and a plurality of pairs of guide camming projections (18) secured to the outer wall surface of said resilient tubular casing along the opposite edges of said gap in such an arrangement that, when said resilient tubular casing is inserted in said tubular frame to a predetermined operative axial position therein, said pairs of guide camming projections are brought into sliding engagement with said respective pairs of camming projections on said tubular frame so as to force said resilient tubular casing radially inwardly to close said gap and, when said resilient tubular casing in moved back from said predetermined axial position in said tubular frame, said resilient tubular casing will normally expand under its own resiliency to open said gap, said guide camming projections (18) being arranged in opposed relation along the opposite edges of said gap (4) in said resilient tubular casing (3) and each have a planar guide face (180) inclined both axially and radially of said resilient tubular casing, and said camming projections on said tubular frame (1) each take the form of a pointed end of a threaded bolt (20) threaded through a nut block in the tubular frame and engaging said planar guide face (180) of the adjacent one of said guide camming projections (18) for sliding engagement therewith whereby the opening and closing of the gap (4) is controlled simultaneously in both circumferential and radial directions, said resilient tubular casing including a radially projecting rib member adjacent each margin of said gap, an axially extending elastic seal means (33) is positioned between said rib members to be compressed therebetween as said tubular casing is moved axially into operative position, and said tubular frame includes a radially inwardly projecting axially directed rib (32) adjacent but radially external of said gap whereby said seal means (33) is compressed between said rib members and said rib as said tubular casing is moved axially into operative position to close said gap and seal the same.

4. A form structure for use in the making of columnar or the like concrete products, comprising: a tubular frame (1) adapted to be driven to rotate about its own axis, a plurality of pairs of opposite camming projections (20) operatively secured to the wall surface of said tubular frame and projecting inwardly therefrom at axially spaced intervals in axially aligned relation to each other, and a resilient tubular casing (3) having a gap (4) in its wall extending longitudinally the length thereof and axially inserted in said tubular frame substantially coaxially therewith, radially extending support means (21, 24) on said frame at side and bottom portions thereof operatively engaging said tubular casing; a plurality of pairs of guide projections (18) secured to the outer wall surface of said resilient tubular casing along the opposite edges of said gap with each guide projection having a planar guide face (180) inclined at an angle of about 30° to the medial plane of the resilient casing and also inclined slightly radially in an axial direction to provide such an arrangement that, when said resilient tubular casing is inserted in said tubular frame to a predetermined axial position therein, said pairs of guide projections are brought into operative sliding engagement with said respective pairs of camming projections on said tubular frame so as to force said resilient tubular casing radially inwardly to close said gap and, when said resilient tubular casing is moved back from said predetermined axial position in said tubular frame, said resilient tubular casing is allowed to expand under the resiliency of its own to open said gap, said resilient tubular casing (3) also being provided with a pair of radially outwardly extending continuous flanges (27) formed along the opposite edges of said gap (4) in said tubular casing and carrying said pairs of guide projections (18) and said tubular frame (1) is provided with an axially extending ridge (30) integrally formed on the inner wall surface thereof in an angular position opposite to said gap (4) in said tubular casing, said tubular casing being further provided with an axially extending elastic packing element (33) arranged between said flanges so as to be compressed under the combined action of said flanges and said ridge as said tubular casing is axially moved relative to said tubular frame to close said gap thereby tightly to seal said gap so closed against leakage of moisture from concrete placed in said resilient tubular casing during centrifugal forming operation.

* * * * *